US006820934B2

(12) United States Patent
Ware et al.

(10) Patent No.: US 6,820,934 B2
(45) Date of Patent: Nov. 23, 2004

(54) CHAIR HAVING FLEXIBLE BACK SUPPORT

(75) Inventors: R. Duane Ware, Temperance, MI (US); William F. Lohness, Jonesville, MI (US)

(73) Assignee: Michigan Tube Swagers & Fabricators, Inc., Temperance, MI (US)

( * ) Notice: Subject to any disclaimer, the term of this patent is extended or adjusted under 35 U.S.C. 154(b) by 0 days.

(21) Appl. No.: 10/691,316

(22) Filed: Oct. 22, 2003

(65) Prior Publication Data

US 2004/0080199 A1 Apr. 29, 2004

Related U.S. Application Data

(63) Continuation-in-part of application No. 10/279,427, filed on Oct. 24, 2002, now Pat. No. 6,679,551, which is a continuation of application No. 09/801,987, filed on Mar. 8, 2001, now Pat. No. 6,471,293.

(60) Provisional application No. 60/247,524, filed on Nov. 9, 2000.

(51) Int. Cl.[7] ..... A47C 3/025; A47C 3/04; A47C 1/024; A47C 1/038

(52) U.S. Cl. ..... 297/285; 297/239; 297/296; 297/299; 297/301.1; 297/301.5; 297/354.1; 297/452.2

(58) Field of Search ..... 297/239, 301.1, 297/354.1, 285, 452.2, 296, 299, 301.3, 301.5, 301.6, 301.7, 303.1

(56) References Cited

U.S. PATENT DOCUMENTS

| | | | | |
|---|---|---|---|---|
| 2,063,781 | A | 12/1936 | Ball | 155/50 |
| 2,587,822 | A | 3/1952 | Corning | 297/301.1 X |
| 2,745,468 | A | 5/1956 | Kramer | 155/53 |
| 2,802,514 | A | 8/1957 | Ninde | 155/54 |
| 2,987,112 | A | 6/1961 | Dorton | 155/162 |
| 3,544,160 | A | 12/1970 | Karasick | 297/354.1 |
| 3,788,586 | A | 1/1974 | McNally | 248/373 |
| 3,973,798 | A | 8/1976 | White | 297/296 |
| 3,982,785 | A | 9/1976 | Ambasz | 297/160 |
| 4,032,190 | A | 6/1977 | Muller-Deisig et al. | 297/353 |
| 4,084,850 | A | 4/1978 | Ambasz | 297/301.1 X |
| 4,235,408 | A | 11/1980 | Sapper | 248/608 |
| 4,333,683 | A | 6/1982 | Ambasz | 297/301.1 X |
| 4,431,157 | A | 2/1984 | Arild | 248/583 |
| 4,549,764 | A | 10/1985 | Haedo | 297/296 |
| 4,580,836 | A | 4/1986 | Verney | 297/296 |
| 4,585,272 | A | 4/1986 | Ballarini | 297/284 |
| 4,597,567 | A | 7/1986 | Racca | 267/140.2 |
| 4,603,830 | A | 8/1986 | Franck | 248/575 |

(List continued on next page.)

FOREIGN PATENT DOCUMENTS

| | | | |
|---|---|---|---|
| AT | 89393 | 9/1922 | 297/301.1 |
| DE | 415483 | 6/1925 | 297/301.1 |
| IT | 257871 | 3/1928 | 297/301.1 |

*Primary Examiner*—Rodney B. White
(74) *Attorney, Agent, or Firm*—Gifford, Krass, Groh, Sprinkle, Anderson & Citkowski, PC

(57) ABSTRACT

A chair comprises a seat support assembly including a seat support, the seat support assembly being adapted to stand on a surface so as to provide the seat support at a suitable height for a person to sit on, and a back support assembly, including a back frame member and a back support. In one embodiment, the back frame member has a curved middle portion substantially in the plane of the back support, and first and second end portions substantially in the plane of the seat support. The back frame member is flexibly interconnected to the seat support assembly by a first spring flexibly interconnecting the first end portion of the back frame member and the seat support assembly; and a second spring flexibly interconnecting the second end portion of the back frame and the seat support assembly.

26 Claims, 6 Drawing Sheets

U.S. PATENT DOCUMENTS 4,603,904 A 8/1986 Tolleson et al. ..... 297/296
4,633,546 A 1/1987 Bergs ..... 16/277
4,666,121 A 5/1987 Choong et al. ..... 248/575
4,790,595 A 12/1988 Hensel et al. ..... 297/285
4,869,552 A 9/1989 Tolleson et al. ..... 297/296
4,877,290 A 10/1989 Schetl ..... 297/270
4,889,385 A 12/1989 Chadwick et al. ..... 297/302
4,892,354 A 1/1990 Estkowski et al. ..... 297/301
4,911,501 A 3/1990 Decker et al. ..... 297/300
4,938,532 A 7/1990 Burgess ..... 297/301
4,943,114 A 7/1990 Piretti ..... 297/301
5,018,787 A 5/1991 Estkowski et al. ..... 297/302
5,024,484 A 6/1991 Buchacz ..... 297/300
5,024,485 A 6/1991 Berg et al. ..... 297/312
5,039,163 A 8/1991 Tolleson ..... 297/297
5,044,587 A 9/1991 Degen ..... 248/158
5,048,893 A 9/1991 Cowan et al. ..... 297/329
5,062,676 A 11/1991 Mars ..... 297/338
5,100,201 A 3/1992 Becker, III et al. ..... 297/300
5,114,210 A 5/1992 Naess ..... 297/300
5,123,702 A 6/1992 Caruso ..... 297/342
5,154,472 A 10/1992 Kaufman ..... 297/23
5,193,880 A 3/1993 Keusch et al. ..... 297/353
5,203,853 A 4/1993 Caruso ..... 297/303
5,261,727 A 11/1993 Klaebel ..... 297/423.13
5,288,127 A 2/1994 Berg et al. ..... 297/312
5,320,410 A 6/1994 Faiks et al. ..... 297/296
5,501,507 A 3/1996 Hummitzsch ..... 297/284.4
5,580,127 A 12/1996 Piretti ..... 297/301.3
5,681,085 A 10/1997 Nahoul ..... 297/302.4
5,697,673 A 12/1997 Favaretto ..... 297/301.1
5,704,688 A 1/1998 Schrewe et al. ..... 297/285
5,762,396 A * 6/1998 Barile ..... 297/239
5,868,468 A 2/1999 Wang ..... 297/320
5,871,256 A 2/1999 Kogai ..... 297/300.2
5,887,945 A 3/1999 Sedlack ..... 297/296
5,890,763 A 4/1999 Asbjornsen ..... 297/285
5,902,012 A 5/1999 Han ..... 297/285
5,904,397 A 5/1999 Fismen ..... 297/291
5,931,531 A 8/1999 Assmann ..... 297/316
5,997,084 A 12/1999 Barile, Jr. et al. ..... 297/239
6,000,755 A 12/1999 Uhlenbrock ..... 297/300.2
6,019,429 A 2/2000 Tedesco ..... 297/328
6,033,021 A 3/2000 Udo et al. ..... 297/313
6,050,642 A 4/2000 Erb ..... 297/322
6,065,803 A 5/2000 Li et al. ..... 297/301.3
6,099,076 A 8/2000 Nagel et al. ..... 297/337
6,174,029 B1 * 1/2001 Swy ..... 297/239 X
6,406,096 B1 * 6/2002 Barile, Sr. ..... 297/296 X
6,471,293 B2 10/2002 Ware et al. ..... 297/239
6,679,551 B2 * 1/2004 Ware et al. ..... 297/239

* cited by examiner

CHAIR HAVING FLEXIBLE BACK SUPPORT

REFERENCE TO RELATED APPLICATIONS

This application is a continuation-in-part of U.S. patent application Ser. No. 10/279,427, filed Oct. 24, 2002, now U.S. Pat. No. 6,679,551 which is a continuation of U.S. patent application Ser. No. 09/801,987, filed Mar. 8, 2001, now, U.S. Pat. No. 6,471,293, which claims priority from U.S. provisional patent application Ser. No. 60/247,524, filed Nov. 9, 2000, the entire contents of all of which are incorporated herein by reference.

FIELD OF THE INVENTION

The present invention relates to chairs, in particular to chairs having a flexible back support.

BACKGROUND OF THE INVENTION

Chairs, such as stackable banquet chairs, are well known in the prior art. They may be designed to stack one atop another when not in use so as to reduce the necessary storage space. The chairs may have a padded seat cushion and a padded back support cushion. The back support is at an angle to the seat cushion and usually is essentially non-flexible.

Numerous attempts have been made to improve the comfort level of chair occupants. For example, there have been various attempts at providing stackable chairs with flexible backs. That is, there have been designs that allow the back support portion of the chair to flex with respect to the seat cushion, thereby allowing an occupant to recline. However, such efforts have often led to complicated mechanisms that would be expensive to manufacture, or less comfortable chairs, for example chairs in which only part of the back support flexes. There is a need for a simple, comfortable, and reliable chair design.

U.S. Pat. No. 2,587,822 to Coming describes a resiliently mounted chair back. However, the described chairs include soft yieldable materials that may weaken the structure. U.S. Pat. No. 3,544,160 to Karasick describes a seat back positioning system, having a relatively complex arrangement having a moving rod.

U.S. Pat. No. 4,084,850 to Ambasz describes a chair with a back connected to a seat support by an articulating connector. U.S. Pat. No. 4,333,683, also to Ambasz, describes a chair with a tilting upper back portion. The disclosed chair has a unitary seat and lower back portion. However, it can be more comfortable to have a back that tilts in its entirety.

U.S. Pat. Nos. 4,603,904 and 4,869,552 to Tolleson et al. describe a chair with a flexible backrest. The seat frame includes a pair of upstanding, spaced apart members protruding above the level of the seat. U.S. Pat. No. 5,039,163, also to Tolleson et al., describes a flexible backrest assembly for a chair. U.S. Pat. No. 4,938,532 to Burgess describes a chair having a torsion bar.

U.S. Pat. No. 6,406,096 to Barile Sr. describes a seat spring system to provide a flexible spring backrest frame. U.S. Pat. No. 6,471,293 to Ware et al. describes a stackable chair with a flexible back support. U.S. Pat. No. 6,533,352 to Glass et al. describes a chair having a reclining backrest, the chair having a pretensioned spring.

However, the prior art fails to offer a chair providing the comfort of a flexible back support using a simplified frame construction.

SUMMARY OF THE INVENTION

A chair comprises a seat support assembly including a seat support, the seat support assembly being adapted to stand on a surface so as to provide the seat support at a suitable height for a person to sit on, and a back support assembly, including a back frame member and a back support. In one embodiment, the back frame member has a curved middle portion substantially in the plane of the back support, and first and second end portions substantially in the plane of the seat support. The back frame member is flexibly interconnected to the seat support assembly by a first spring flexibly interconnecting the first end portion of the back frame member and the seat support assembly; and a second spring flexibly interconnecting the second end portion of the back frame and the seat support assembly.

DETAILED DESCRIPTION

In one embodiment of the present invention, a chair includes a back support assembly, and a seat support assembly to which the back support is flexibly interconnected. The back support assembly comprises a back frame and a back support, so that a person can lean back against the back support when sitting on a chair. The seat support assembly comprises a seat support frame and a seat support. When a person sits on the seat support, the weight of the person is borne by the seat support frame. Seat supports and back supports may include cushioned materials, as is well known in the art.

The terms front, back, left, right, and similar terms will be used for convenience in describing examples below, but such designations are for convenience only and are not intended to be limiting. The terms front, back, left and right sides are used here from the viewpoint of a person sitting (in a conventional manner) in a chair. Where individual components are discussed, such terms relate to the component as it may be disposed in a chair embodiment.

Figure 1:
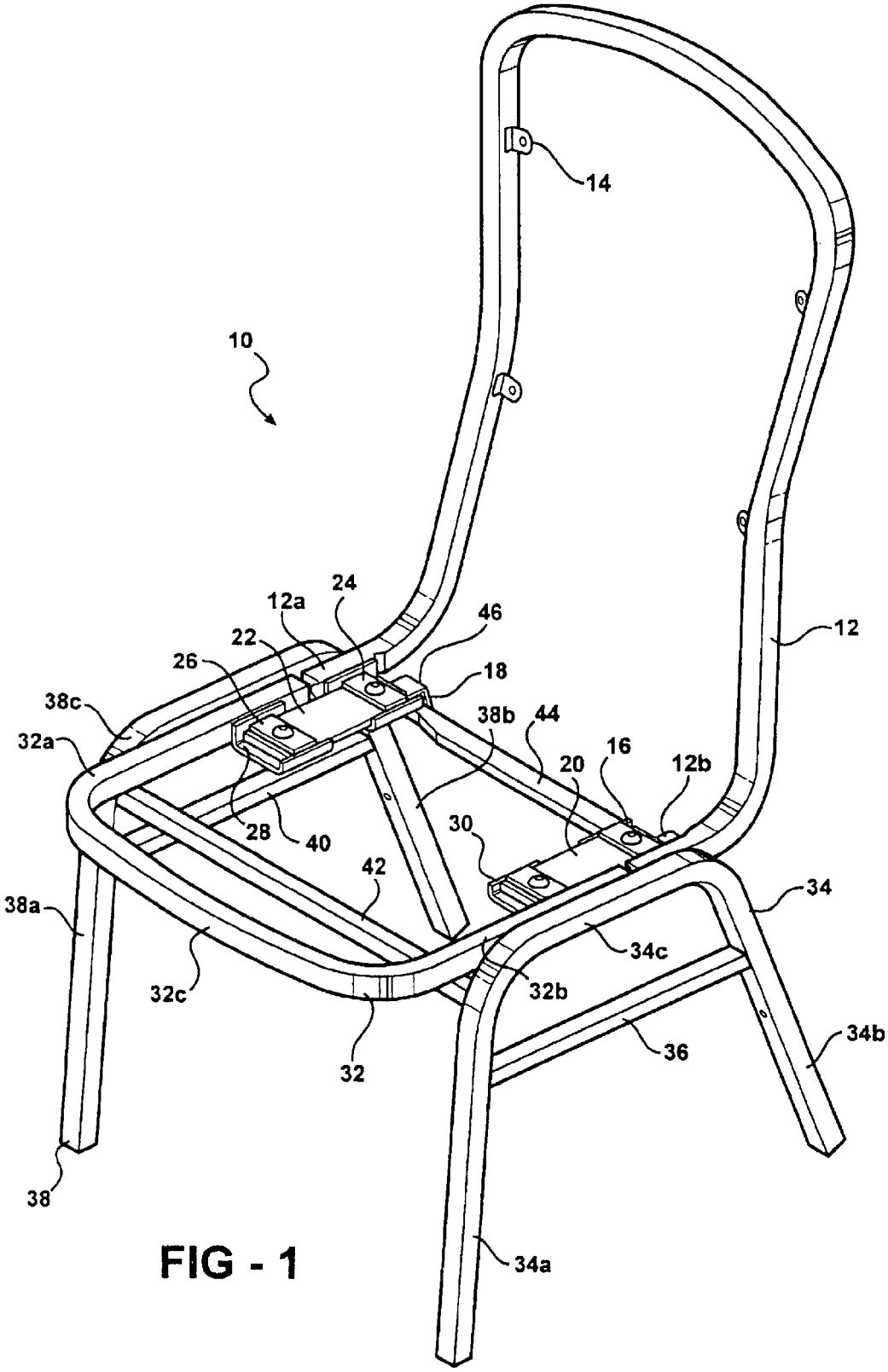
FIG. 1 shows a view of a chair frame according to an embodiment of the present invention.
Figure 2:
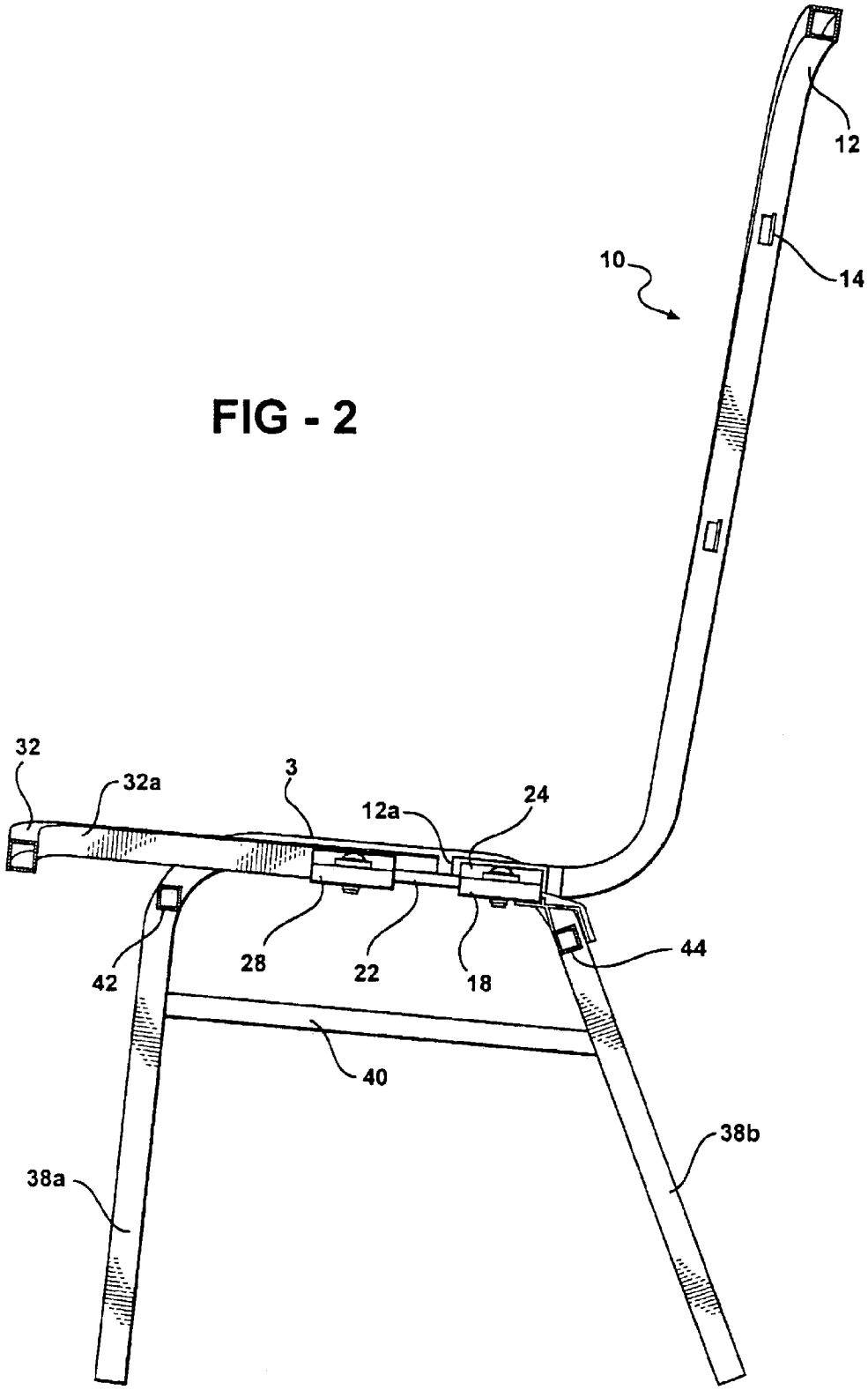
FIG. 2 shows a side sectional view of a chair frame.
Figure 3:
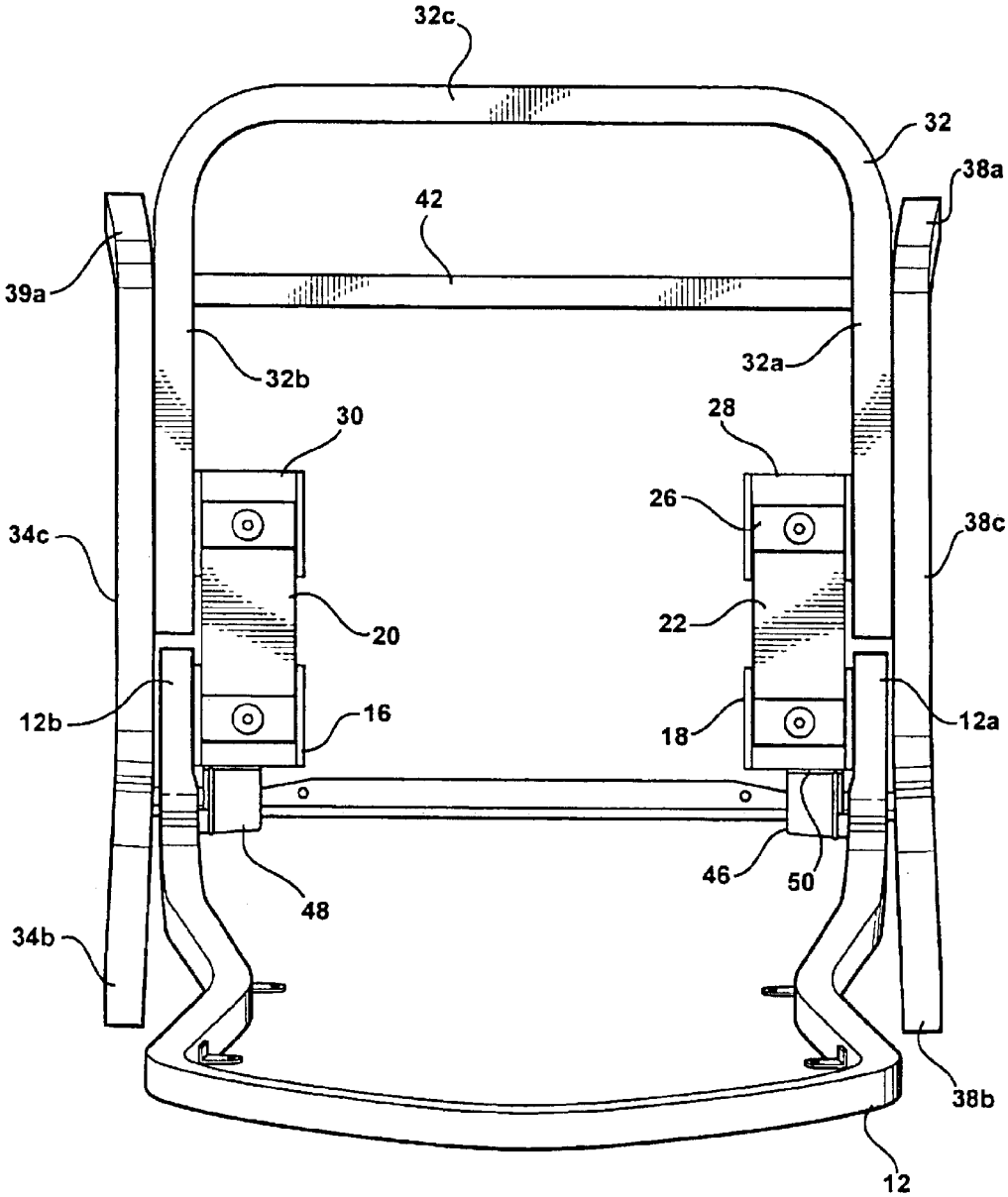
FIG. 3 shows a top view of a chair frame.

FIGS. 1–3 shows a chair frame according to an embodiment of the present invention generally at 10. The chair frame 10 includes a back frame, the back frame being provided by back frame member 12. The back frame member is flexibly interconnected to a seat support frame by a pair of springs, the springs being spaced apart, as discussed in more detail below. The back frame member 12 is a single curved member having a right end portion 12*a*, a left end portion 12*b*, and a central portion 12*c*. A back left spring channel 16 is attached to the left end portion 12*b* of back frame member 12, proximate to the left end of the back frame member 12. A back right spring channel 18 is attached to the right end portion 12*a* of the back frame member 12, proximate to the right end of the back frame member 12. A number of back support attachment tabs such as 14 are also attached to the back frame. The attachment tabs act as brackets, allowing a back support (such as a cushion or curved sheet) to be connected to the back frame assembly. For example, the back frame member 12 can be formed from tubular steel and the attachment tabs such as 14 welded or otherwise attached to the back frame.

The seat support frame, shown in FIGS. 1–4, comprises a left leg assembly including a left leg member 34 and a left stack bar 36, a right leg assembly including right leg member 38 and right stack bar 40, U-shaped member 32, front lateral bar 42, back lateral bar 44, front left spring channel 30, and front right spring channel 28.

The left leg member 34 is a single curved member having a front left leg portion 34*a*, a back left leg portion 34*b*, and a central portion 34*c* connecting the front left leg portion and the back left leg portion. Similarly, the right leg member 38 is a single curved member having a front right leg portion 38*a*, a back right leg portion 38*b*, and a central portion 38*c* connecting the front right leg portion and the back right leg portion. The stack bars 36 and 40 strengthen the respective leg assemblies and help stackability of chairs using this frame.

The U-shaped member 32 has a right arm 32*a*, a left arm 32*b*, and a middle portion 32*c*. The right arm 32*a* of the U-shaped member 32 is attached to the central portion 38*c* of the right leg member 38. The left arm 32*b* of the U-shaped member 32 is attached to the central portion 34*c* of the left leg member 34. Hence, the middle portion 32*c* of U-shaped member 32 connects the left leg member 34 and the right leg member 38. The U-shaped member substantially defines the plane of the seat support, as the seat support is preferably supported on the U-shaped member. The middle portion 32*c* of the U-shaped member is proximate to the front of the chair so that the ends of the left arm and right arm of the U-shaped member are proximate to the back of the chair.

The seat support frame also includes the front left spring channel 30, attached to the left arm 32*b* of the U-shaped member 32 proximate to the end of the left arm, and the front right spring channel 28, attached to the right arm 32*a* of the U-shaped member proximate to the end of the right arm.

The seat support frame and the back frame are connected by a pair of springs. Left spring 20 and right spring 22 act so as to flexibly interconnect the back frame member 12 and the seat support frame. Left spring 20 is seated in the front left spring channel 30 and in the back left spring channel 16. Right spring 22 is seated in the front right spring channel 28 and in the back right spring channel 18. The springs are secured by spring keepers such as 26, the spring keepers being held in place by bolts such as bolt 24 which pass through holes in each spring. Each spring has two holes, a front hole used to connect the spring to a spring channel on the seat support frame, and a back hole used to connect the spring to a spring channel on the back frame. The left spring and the right spring allow the back frame member to flex in relation to the seat support assembly, such as when a person leans back on a back support supported by the back frame member.

In a finished chair, a seat support is supported by the seat support frame. For example, a seat support can be dropped onto the seat support so as to rest on the front and back lateral bars and/or the U-shaped member. A seat support can be screwed, bolted, or otherwise secured to the seat support frame. Similarly, a back support can be attached to the back frame by any convenient method.

This frame design does not have a lateral bar connecting the two end portions of the back frame member, simplifying construction. The left end portion and right end portion of the back frame member are of course mechanically connected through the middle portion of the back frame member, but the only other mechanical connection between the two end portions is through the springs and seat support frame.

FIG. 2 shows chair frame 10 in side view in cross-section through the middle of the chair. This sectional view cuts through the front lateral bar 42, back lateral bar 44, and U-shaped member 32, which connect the left leg assembly and the right leg assembly. As shown in FIG. 2, the frame members are formed from tubular materials having a generally square cross-section. As discussed below, other cross-sections can be used, such as circular, oval, or rectangular cross-sections, I-beams, solid frame members, and the like.

FIG. 2 further illustrates the back frame member 12 having end portions that lie substantially in the plane of the seat support. FIG. 2 shows a side view of the right end portion 12*a* of the back frame member 12 and the right arm 32*a* of the U-shaped member 32, which are flexibly interconnected by the right spring 22. The right spring 22 is seated in front right spring channel 28 and back right spring channel 18.

Unlike other many other prior art chair frames, in this example the left end portion and right end portion of the back frame member are not directly connected by a lateral bar. The two end portions of the back frame member are connected by the middle portion of the back frame member, and through the seat assembly through the pair of springs 20 and 22.

FIG. 2 also shows right finger guard 46. The finger guard acts to protect fingers or other body parts from being pinched as the chair is flexed. Finger guards are well known in the chair arts, and this aspect of the chair will not be discussed in detail. The finger guard can be formed from polypropylene and riveted to the seat support assembly. The finger guard provides a shield extending over the back lateral bar, to prevent fingers prying between the back frame assembly and the seat support assembly. A rivet 50 is used to attach finger guard 56 to the underneath of the spring channel 18. The back lateral bar is thinner at the ends to allow a finger guard to come down over it without too much interference, which can help conceal the finger guard. In other embodiments, the finger guard may be omitted, and mechanisms provided to restrict the degree of flexing of the springs.

FIG. 3 shows a top view of the chair frame. The back frame member 12 is shown at the bottom of the figure, so that the left hand side of the chair, as used in this specification, is on the left. In any case, the terms left and right are used for convenience and are not limiting. The symmetry of most chair embodiments renders the left and right designations as arbitrary.

FIG. 3 shows the back frame member 12 from above, which in this view extends upwards towards the observer. The top view also shows right finger guard 46 and left finger guard 48.

Figure 4:
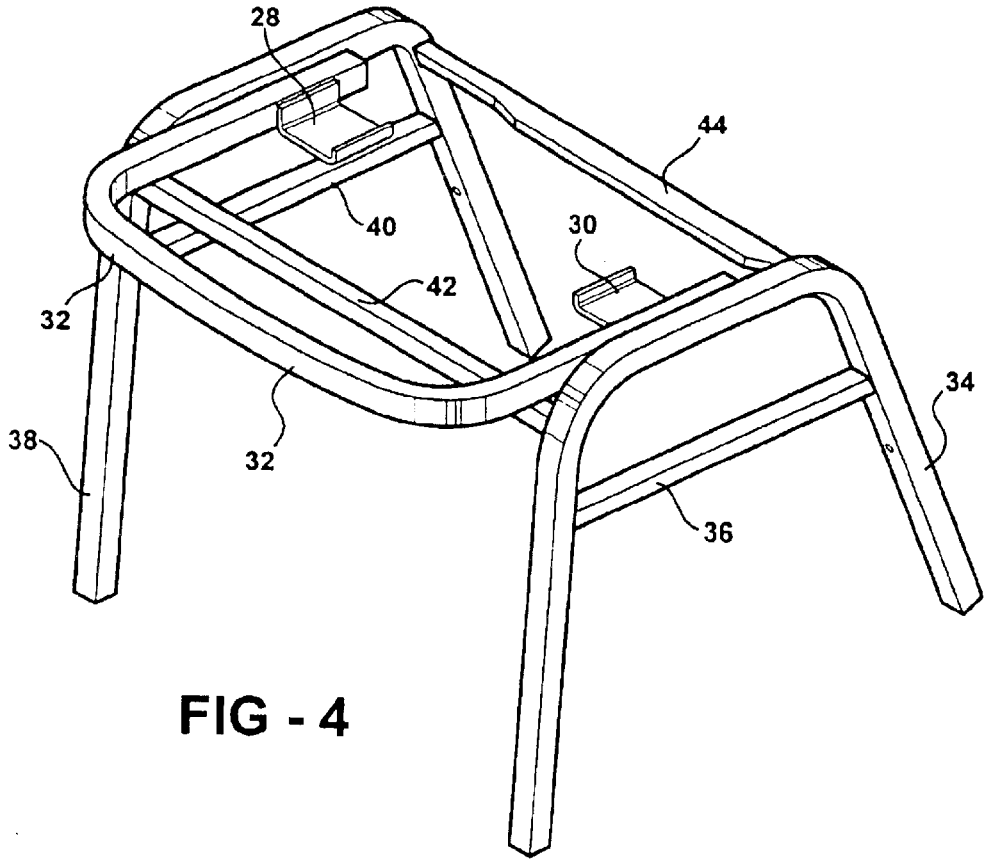
FIG. 4 shows a seat support assembly having spring channels.

FIG. 4 illustrates the seat support frame, and provides a view of the front left spring channel 30 and front right spring channel 28. The back frame member can be flexibly interconnected to the seat support assembly by left and right springs secured in the front left spring channel and front right spring channel (respectively) on the seat support, the springs being attached to the back left spring channel and back right spring channel on the left and right end portions (respectively) of the back frame member.

Figure 5A:
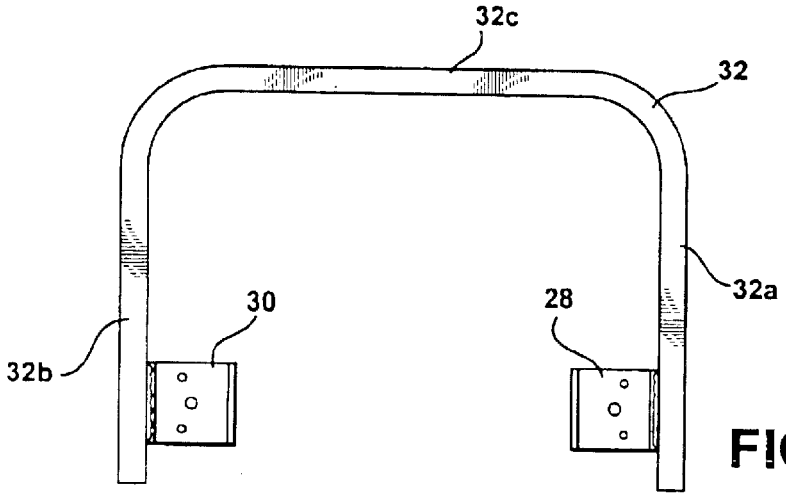
FIGS. 5A and 5B show views of a U-shaped member, used in a seat support assembly according to an embodiment of the present invention.
Figure 5B:
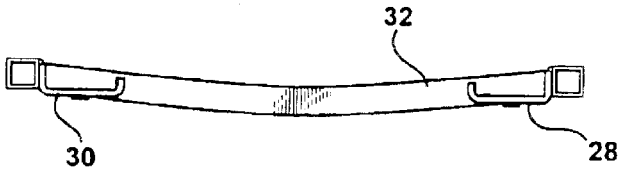

FIG. 5A shows a top view of the U-shaped member 32 in isolation, the U-shaped member having front left spring channel 30 and front right spring channel 28 welded to it. The small "xxx" symbols in the figure indicate the general position of welds. FIG. 5B shows a view corresponding to that seen from behind a chair, further illustrating the cross-sectional shape of the spring channels 28 and 30.

Figure 6A:
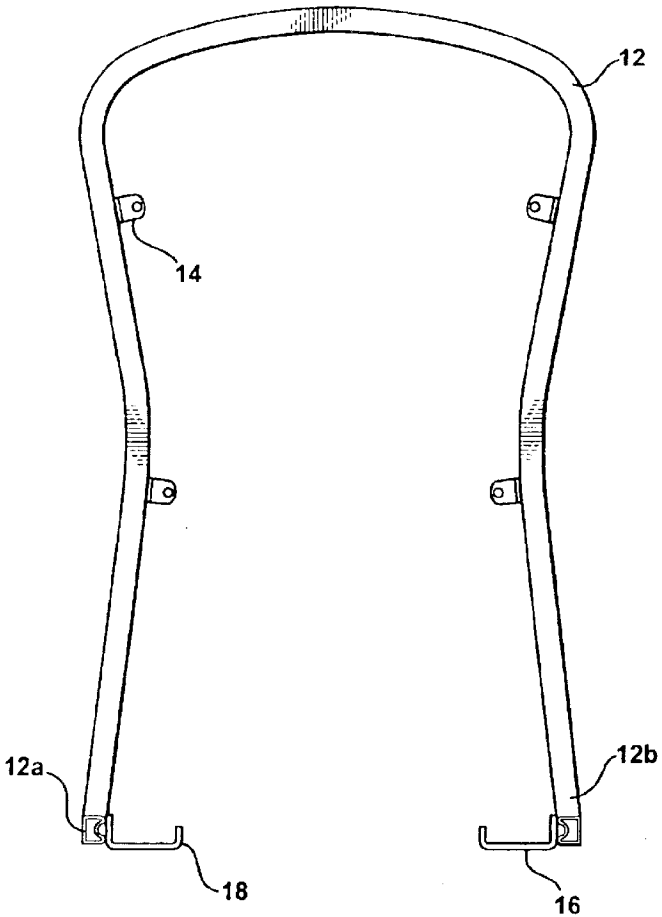
FIGS. 6A–6D show views of the back frame member.
Figure 6B:
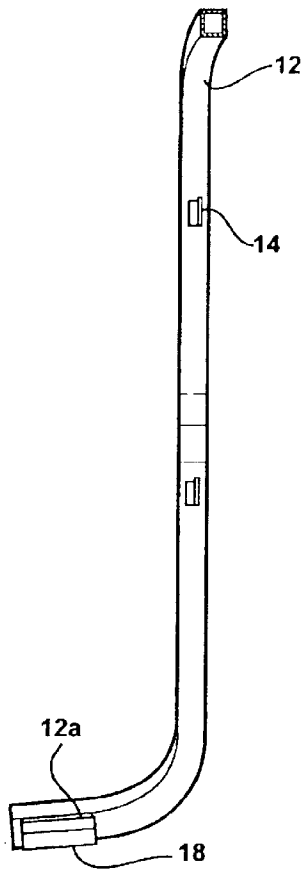
Figure 6C:
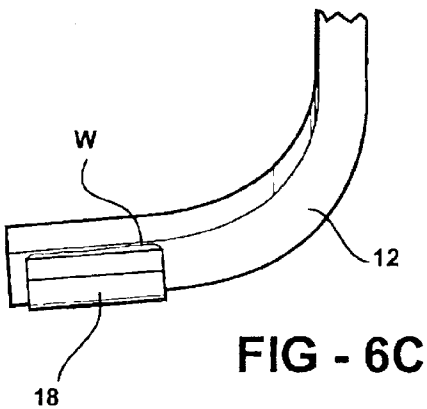
Figure 6D:
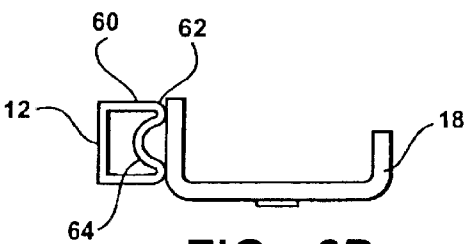

FIG. 6A shows a view of the back frame member 12, with back right spring channel 18 and back left spring channel 16 attached by welds. FIG. 6B shows a section (A—A) through the middle of the back frame member, showing a view of the back right spring channel 18. FIG. 6C shows a section (B—B) through the spring channel 18, showing the general position of welds. As shown in the circled area W, the welds go around the corners of the spring channel. FIG. 6D shows an end view of one end of the back frame member, showing the attachment of the spring channel 18. The cross-section of the back frame member in the spring channel attachment area has a concave indentation 64, the spring channel being welded to the top and bottom of the side of the tubes. In this example, weld material 62 does not cover any portion of the upper surface of the end portion of the back frame member, shown at 60.

Figure 7:
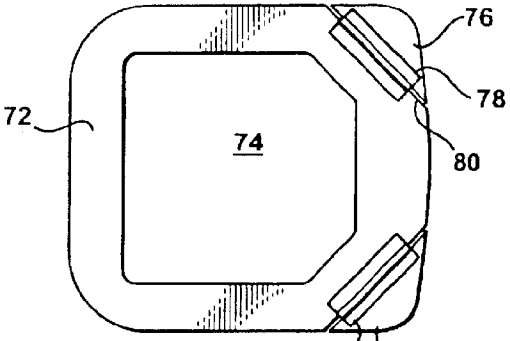
FIG. 7 shows an underneath view of a seat support having two corner pieces.

FIG. 7 shows an underneath view of a seat support, shown generally at 70. The seat support may be attached to a seat support frame, so as to support the seat of a subject. The seat support comprises a cushioned layer (not shown in the underneath view) supported by a support layer.

The underneath view shows the support layer as including an outer support layer 72, an inner support layer 74, a back right corner piece 82 flexibly connected to the outer support layer by first flexible member 78, a back left corner piece 76 flexibly connected to the outer support layer by second flexible member 84, the corner pieces being separated from the outer support layer by gaps 80 and 86.

The support pieces and/or corner pieces may be formed from rigid materials, such as wood, plastic, metal, laminate, or the like. The flexible members 78 and 84 may be formed from flexible plastic, such as a living hinge material. A living hinge may comprise a thin portion of flexible plastic such as polyethylene or polypropylene. For illustrative convenience, FIG. 7 shows the flexible members as transparent, but they may also be opaque.

The inner support layer and outer support layer together form a central support region, to which one or more corner pieces may be flexibly attached. The central support region can comprise a rigid material, such as wood, metal, plastic, composite, laminate, or other material. Similarly, a corner piece can comprise a rigid material.

In other embodiments, the seat support can be formed from a piece of plastic, including a central support region and at least one corner piece flexibly connected to the central support region through a thinned region, for example as a living hinge. The corner piece, flexible member, and central portion can be formed from a single piece of material.

The central support region and corner pieces can be used to support a cushioned layer. The cushioned layer will deform in sympathy with movements of the corner piece. The cushioned layer can provide the flexible interconnection between the central support region and the corner piece.

Alternatively, a flexible material can be bonded to one side of a rigid material, and cuts in the rigid material used to define the hinge regions and corner pieces. Other embodiments will be clear to those skilled in the art.

The seat support is preferably attached to the seat support frame through attachments to the central support region. The corner pieces are then free to move if an object, such as a dog's nose, becomes trapped between the seat support and the seat support frame, or by the back frame as it is flexed. Hence, the flexibly connected corner pieces provide an important safety benefit.

In other embodiments, the seat support may comprise a rigid central support region, a flexible peripheral support region, and a cushioned layer supported by the central support region and the flexible peripheral support region. The flexible peripheral support region may be restricted to the back of the chair, or to one or more corners. Alternatively, the seat support may comprise a rigid central support region, and a rigid back piece flexibly connected to the rigid central support region. A cushioned layer may then be supported by the central support region and the back piece. Alternatively, the seat support may comprise a rigid central support region, and two side pieces flexibly connected to the rigid central support region. The term corner piece will be used to refer to any piece of the seat support including a corner (which may be quite rounded) of the seat support. Hence, a back or side piece is a form of corner piece. In other embodiments, corner pieces may comprise resilient materials directly connected to a rigid central support region, and the flexible connections omitted.

Figure 8:
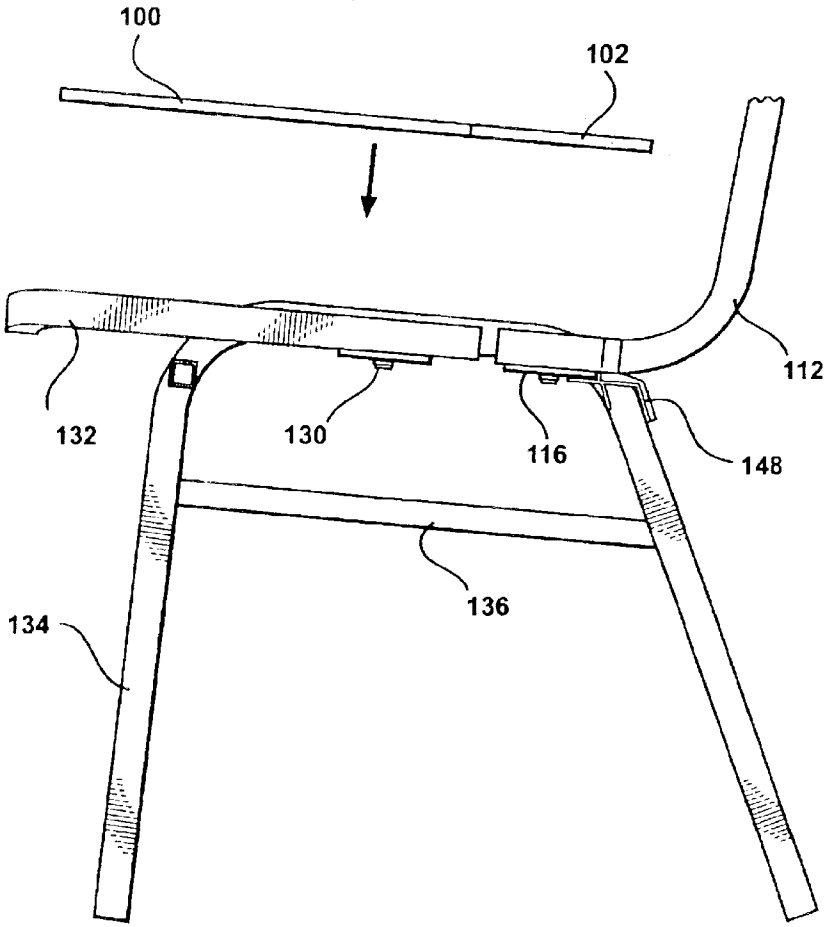
FIG. 8 shows a side view of a chair indicating positioning of a seat support.

FIG. 8 shows a side view of a chair having back frame member 112, and a seat support assembly including U-shaped member 132, leg member 134, left stack bar 136, front left spring channel 130, back left spring channel 116, and left finger guard 148. Seat support 100 is positioned on the seat support assembly (lowering the seat support is shown by arrow A). The seat support has back left corner piece 102 separated from the larger portion of the seat support (the central support region) by gap 104. A flexible member (not shown) connects the back left corner piece to the remainder of the seat support. In other embodiments, a flexible material may fill gap 104 so as to connect the corner piece to the central support region.

Figure 9:
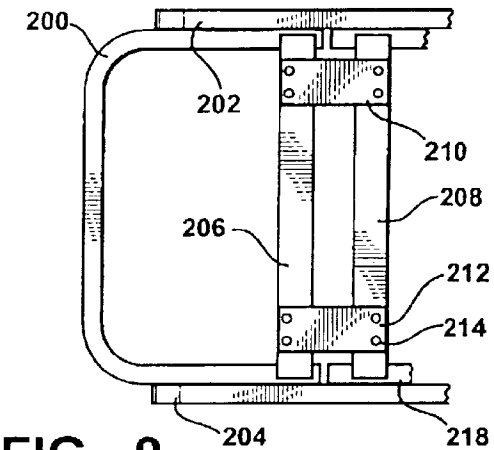
FIG. 9 shows an alternative embodiment, having a pair of spaced apart springs attached to a lateral bar within the seat support assembly.

FIG. 9 shows another embodiment of a chair frame according to an embodiment of the present invention. Only a portion of the chair frame is shown. The chair frame includes a seat support frame, having a U-shaped member 200, right leg member 202, left leg member 204, seat frame lateral bar 206, back frame lateral bar 208, right spring 210, left spring 212, spring attachment 214, and a back frame member having a right end portion 216 and left end portion 218 (the central portion is omitted for convenience).

The end portions of the back frame member are connected by the back frame lateral bar 208, and the left spring and right spring are attached to the back frame lateral bar. The seat assembly lateral bar 206 connects the left end portion and right end portion of the U-shaped member, and the left spring and right spring are attached to the seat frame lateral bar so as to flexibly interconnect the back frame and the seat support frame.

As discussed above, a finger guard can be provided to prevent figures from being trapped as a chair back leans backwards or returns to its original position. The finger guard can prevent crushing of fingers when a chair back assembly is flexed. The angular range of flexing can be limited by any convenient method. For example, spring channels, frame members, or flanges thereon may contact after flexing so as to prevent flexing beyond a predetermined degree.

Chair frame members may be formed from tubular metal, such as tubular steel. Other construction materials can be used, such as plastic tubing, solid plastic, solid metal, composites, wood, and the like.

Seat supports may be formed from molded plastic, wood, metal, composites, and the like. A seat support may include a rigid backing material, such as wood, metal, or plastic, supporting a foam layer. Foam may be covered by a fabric material or other flexible material. Back supports can be formed in any convenient manner, for example in a similar manner to the seat support. For example, a back support may be a curved piece of plastic which can be connected to the back frame using attachment tabs.

Springs used in embodiments of the present invention may be formed from fiberglass. For example, each spring can be elongated, have a flattened cross-section, be formed from a non-woven fiberglass reinforced epoxy resin, and have approximately rectangular profiles when viewed from the sides or top. For example, the spring can be a flattened cuboid. The term flattened cross-section refers to a spring cross section that is wider than it is thick, for example at least twice as wide as it is thick. In one embodiment, the spring width is over six times greater than the spring thickness.

However, other spring shapes can be used. Spring cross-sections may be rectangular, square, oval, or other shapes. (Here, the term cross-section refers to a transverse cross-section at right angles to the direction of elongation). Spring cross-sections may be uniform along the length of the spring, or may vary. Springs may be formed from multilayered laminated materials, layered fiberglass, and the like. Springs may comprise metal (such as spring steel), plastic, rubber, synthetic rubber, composite materials, or other materials, or combination of materials. Springs may be formed from a single material, such as an elongated piece of spring steel, or may comprise multilayer structures such as laminates, composites, and the like. Springs may also be spiral springs.

Springs may have a portion of reduced cross-sectional area, for example between portions engaged by spring channels, to increase flexibility. Springs may be adjusted for different resiliency, for example by adjustably tightening a portion of resilient material against a rigid backing material, spring channel, or frame member. In this context, a resilient material is one that can be flexed by application of a force, and which tends to return to an unflexed state after the force is removed.

Each spring may have a pair of holes, a first hole through which the spring is secured to the seat support frame, and a second hole through which the spring is secured to the back frame. Other attachment methods can be provided.

A spring may be secured within a spring channel by any convenient method. In one embodiment, a spring keeper, in the form of a flat metal plate having a central hole, is provided to clamp a spring in a spring channel. A bolt or other securing mechanism passes through the hole in the spring keeper, through a hole in a spring, then into a threaded hole in the spring channel. Tightening up the bolt holds the spring keeper firmly against the spring, securing it in the spring channel. The threaded hole in the spring channel can be formed in a thickened portion of the spring channel, or may comprise a threaded tube longer than the thickness of the spring channel, so as to provide a more secure attachment. The springs may be removed by loosening and removing the spring keepers. In other embodiments, springs may be directly welded to the seat support frame and/or the back support frame.

In the assembled chair frame shown in FIGS. 1–3, the left and right end portions of the back frame member 12 are substantially parallel to and in register with the left arm and right arm (respectively) of the U-shaped member 32. In other embodiments, the respective portions may be substantially parallel but not in register (for example, separated laterally by approximately the width of a spring channel, the spring channels being on the outward side of the back frame member and the inner side of the U-shaped member, or vice versa), or substantially in register but not parallel.

Referring back to FIGS. 1 and 2, in the illustrated example the left and right end portions of the back frame member are bent through approximately 85 degrees with respect to the central portion of the back frame member. The end portion bending angle is part of the manufacturing process, and does not substantially change when the chair is in use. Hence, when the back support is in its original position, springs unflexed, the angle between the seat support plane and the back support plane is approximately 95 degrees.

As a person leans back on the back support, the springs bend so as to allow the back support to lean backwards. For example, if the springs bend through 2 degrees, the angle between the end portions of the back frame and the arms of the U-shaped member will become 2 degrees, and the back support will be at an angle of approximately 97 degrees with respect to the seat support. When the person stops leaning back on the back support, the natural resiliency of the springs tends to return the seat back to its original position. In other embodiments, different end portion bending angles may be used, such as 70, 75, 80, or 90 degrees, or intervening angles, and the end portion bending angle may change when a person leans back on the chair, for example if the back frame member is discernibly resilient when a person leans back against it.

In other embodiments, the back frame may be flexibly interconnected to the seat support assembly through a single spring, preferably centered with respect to the seat support. A back frame lateral bar, traversing the lower part of the back support frame, can be mechanically associated with one or more springs. In other embodiments, the back frame member can be a closed loop, the lower part of which can be mechanically associated with one or more springs. In various embodiments, two, three, four, five, or more springs may be used. For example, a number of springs may be evenly spaced, or disposed as two pairs of springs on the left and right sides of the chair respectively, or disposed any configuration.

Other reinforced composites may be used as or part of springs, such as carbon fiber, carbon nanotube, graphite, aramid fiber, boron fiber (as discussed in U.S. Pat. No. 6,514,370), boron nitride, fabric, ceramic whisker, metal fiber, other non-glass fiber or tube, or other reinforced composites. Reinforced resins may be thermoplastic or thermoset (for example, polyester, vinyl ester, or epoxy resins), for example as supplied by GLASFORMS of San Jose, Calif. Fiber reinforcements can be aligned with the long axis of an elongated spring. Springs can be formed from multiple layers comprising sheets of one or more materials. Springs can be formed from a single material, or multi-component assemblies can be used.

In embodiments of the present invention, the spring channels are welded to frame members, and have a recess adapted to receive a spring. In some embodiments, the spring channel has a first side wall, welded to a frame member, a base, and a second side wall. The first side wall may be taller than the second side wall, so as to provide a generally J-shaped profile.

In one example, the spring is formed from fiberglass reinforced epoxy resin, having a spring length of greater than 5 inches (such as 5.4 inches), a spring width of approximately 2 inches, and a spring thickness of approximately 0.3 inches. In this example, a spring channel may have an approximately J-shaped interior profile, having a first side wall approximately 11/16 inches high welded to a frame member, a floor (or central portion), and a second side wall approximately half the height of the first spring wall, for example 5/16 inches high. The recess width provided by the spring channel is the distance between the first side wall and the second side wall, approximately the width of the floor. The recess width is greater than the spring width, for example equal to or less than 1/8 inch greater than the spring width, to allow the spring channel recess to receive the spring so that at least part of the width of the spring (on one side of the spring) contacts the floor of the spring channel. For example, a spring channel recess may have a width of 2 1/64 inches to engage a spring having a width of 2 inches.

The bottom of the spring channel can be substantially flat, with rounded interior corners, or may have a concave (or other) profile to support and stabilized the spring. A drilled and tapped hole can be used to receive a bolt, the bolt passing through a hole in the spring so as to secure the spring to the spring channel. The bolt may also pass through a spring keeper, which may be in the form of a flat plate having a hole therethrough, or in the form of a washer. The base of the spring channel can be further shaped so as to stabilize a spring secured therein, for example by having indentations or grooves matched to protrusions on the spring. The profile of the spring channel can complement that of the spring in areas where they contact.

In other embodiments, a spring channel may be tubular, toroidal, cup-shaped, or other shape through or on which a spring may be supported, protrude, or enter. Spring channels may be flat plates, to which a spring may be attached. Springs may be alternatively be directly attached to frame members without using spring channels, for example by welding or other attachment methods. In other embodiments, the spring can attach to the underside of a spring channel.

In embodiments of the present invention, a U-shaped member is provided having a generally U-shaped form with generally parallel arms and a central portion. However, other shaped frame members or combination of frame members can be provided to support the seat support, or to support spring channels, or otherwise be mechanically associated with springs. For example, spring channels can be attached to frame members running along the left and right sides of the seat support frame, or to a lateral bar running along the back of the seat support frame, or to another frame member. Spring channels (or springs) may also be attached to leg members, frame members acting as one or more legs of the chair frame, lateral bars, or other frame members.

In other embodiments, a seat support assembly may comprise a leg assembly including a central support pillar connected to a number of radially disposed leg members, each leg member having a caster. A U-shaped member (or other seat support frame members) may be provided having attached spring channels. Alternatively, one or more springs may be attached to a rigid seat support. In one embodiment, a frame member extends back from the central pillar, along the mid-line of the seat support, and is connected to one or more springs, either directly or through a lateral bar. Alternatively, a transverse bar across the back of the seat support can be connected to the central support pillar through one or more frame members, or as part of a curved frame member attached to the central support pillar, and be connected to one or more springs, either through a spring channel or equivalent, or directly.

In other embodiments, a chair frame may include a pair of leg assemblies in the form of loops, each loop providing the equivalent of a pair of legs and (possibly) an armrest. In some embodiments, springs may be attached to the rear portion of leg assemblies, or to frame members attached to the leg assemblies, or to a lateral bar connecting a pair of leg assemblies.

Attachment methods, which may be used to interconnect chair frame members, springs, and other chair components, include welds, adhesives, ultrasonic bonding, bolts, rivets, thermal bonding methods, clamps, nails, screws, and the like. In other embodiments, a spring and attached frame member may be formed as a unitary structure by molding or some other technique.

The above described examples are provided for illustrative purposes, and are not intended to be limiting. Other embodiments of the invention will be clear to those skilled in the art.

What is claimed is:

1. A chair, the chair comprising:

a seat support assembly, the seat support assembly including a sear support and a seat support frame including at least one leg assembly, the seat support frame supporting the seat support, the seat support frame having a left arm and a right arm that are generally coplanar with the seat support; and a back support assembly, including a back frame and a back support, the back frame including a back frame member, the back frame member being a single curved member having a central portion lying substantially in the plane of the back support, a left end portion, and a right end portion, the left and right end portions being substantially in the plane of the seat support, the left end portion being aligned with the left arm of the seat support frame and the right end portion being aligned with the right arm of the seat support frame;

a front left spring channel connected to the left arm of the seat support frame;

a back left spring channel connected to the left end portion of the back frame member;

a front right spring channel connected to the right arm of the seat support frame;

a back right spring channel connected to the right end portion of the back frame member;

each of the spring channels having a substantially J-shaped or U-shaped cross-sectional profile with a generally upwardly directed opening, a first side wall, a floor, and a second side wall;

a left spring and a right spring, the seat support frame and the back frame being flexibly interconnected by the left spring and right spring, the left spring engaging with the front left spring channel and the back left spring channel, the left spring engaging with the front right spring channel and the back right spring channel;

each spring being formed from an elongated non-extensible member, wherein the left spring is connected to the left end portion of the back frame member, and the right spring is connected to the right end portion of the back frame member.

2. The chair of claim 1, wherein the sear support frame includes a U-shaped member defining the left arm, a the right arm, and a central portion, the U-shaped member lying substantially in the plane of the seat support, the left arm being substantially parallel to the left end portion of the back frame member, the right arm being substantially parallel to the right end portion of the back frame member.

3. The chair of claim 2, wherein the left arm is substantially in register with the left end portion of the back frame member, and the right arm is substantially in register with the right end portion of the back frame member.

4. The chair of claim 1, wherein each spring channel has at least one hole in its floor so as to facilitate secure engagement with an engaged spring.

5. The chair of claim 1, wherein the left spring is substantially parallel to the left end portion of the back frame member, and the right spring is substantially parallel to the right end portion of the back frame member.

6. The chair of claim 1, wherein the front left spring channel engages the left spring using a bolt passing through a front left spring keeper and a front left spring hole in the left spring, the bolt engaging with a tapped hole in the floor of the front left spring channel.

7. The chair of claim 1, wherein the back left spring channel engages with the left spring using a bolt passing through a back left spring keeper and a back left spring hole in the left spring, the bolt engaging with a tapped hole in the floor of the back left spring channel.

8. The chair of claim 1, wherein the left spring and right spring both comprise a fiberglass reinforced epoxy resin.

9. The chair of claim 1, wherein the left spring and right spring both have a substantially rectangular cross-section, the springs flexing within a plane parallel to the shorter sides of the substantially rectangular cross-section.

10. A chair frame, comprising:

a seat support frame adapted to rest on a surface, the seat support frame having at least one leg assembly;

a back frame member having a curved middle portion, a left end portion and a right end portion, at least one front spring channel interconnected with the back seat support frame;

at least one rear spring channel interconnected with the back frame member;

each of the spring channels having a substantially J-shaped or U-shaped cross-sectional profile with a generally upwardly directed opening; and a spring, flexibly interconnecting the back frame member and the seal support frame, the spring having a front end interconnected with the front spring channel and a rear end interconnected with the back frame member;

wherein the only mechanical connection between the back frame member and the seat support frame, is provided through the spring.

11. The chair frame of claim 10, wherein the spring is elongated and non-extensible.

12. The chair frame of claim 10, wherein the at least one front spring channel includes a left front spring channel and a right front spring channel, the at least one rear spring channel includes a left rear spring channel and a right rear spring channel, the spring channel including a left spring, and a right spring, the left front spring channel and left rear spring channel engaging the left spring, and the right front spring channel and right rear spring channel engaging the right spring.

13. The chair frame of claim 12, wherein the seat support frame includes a U-shaped member having a central portion, a left arm, and a right arm, wherein the left arm of the U-shaped member is substantially parallel to and in register with the left end portion of the back frame member, the right arm of the U-shaped member is substantially parallel to and in register with the right end portion of the back frame member, the front left spring channel is attached to the left arm of the U-shaped member, and the front right spring channel is attached to the right arm of the U-shaped member.

14. The chair frame of claim 10, wherein the left end portion and right end portion of the back frame member are at a back frame bending angle to a back support plane substantially defined by the curved middle portion of the back frame member.

15. The chair frame of claim 14, where the back frame bending angle is approximately 85 degrees.

16. A flexible interconnection for flexibly interconnecting a seat support assembly and a back support assembly of a chair, the flexible interconnection comprising;

a pair of spaced apart front spring channels attached to the seat support assembly;

a pair of spaced apart back spring channels attached to the back support assembly; and a pair of spaced apart springs, each spring being engaged with one back spring channel and one front spring channel, wherein both springs are elongated, and wherein each spring channel includes a first, generally vertical side, a second, generally vertical side, and a generally horizontal central portion connecting the first side and the second side, so as to define a substantially U-shaped or J-shaped cross-sectional profile defining a spring channel recess that provides spring engagement, whereby the act of sitting on the seat support assembly and leaning back against the back support assembly causes the back support assembly to tilt backwards due to flexing of each spring.

17. The flexible interconnection of claim 16, wherein each spring engages with one back spring channel using a back connector, and engages with one front spring channel using a front connector, each spring having a front hole and a back hole extending therethrough, the front hole receiving the front connector and the back hole receiving the back connector.

18. The flexible interconnection of claim 16, wherein each spring has a spring length and a transverse cross-section, the transverse cross-section being orthogonal to the spring length, each spring being elongated along the spring length.

19. The flexible interconnection of claim 18, wherein the transverse cross-section is substantially rectangular, the transverse cross-section being defined by a spring width and a spring thickness, the spring width being greater than the spring thickness, wherein flexing of each spring is in a flexing plane containing (he spring length and spring thickness.

20. The flexible interconnection of claim 18, wherein at least part of the transverse cross-section is adapted to be received by the substantially U-shaped or J-shaped cross-sectional profile of each spring channel.

21. The flexible interconnection of claim 18, wherein the spring length is greater than 5 inches, the spring width is approximately 2 inches, and the spring thickness is approximately 0.3 inches.

22. The flexible interconnection of claim 18, wherein each spring comprises fiberglass reinforced epoxy resin.

23. The flexible interconnection of claim 18, wherein each spring channel provides a recess having a recess cross-section that is substantially complementary to at least part of the transverse cross-section of each spring.

24. A chair having a left side, a right side, a front side, a back, a seat support supporting a seat of a person, and a back support supporting a back of the person, the chair comprising:

a seat support assembly, including a left leg assembly, having a curved left leg member, the curved left leg member having a front left leg portion a back left leg portion, and a central portion connecting the front left leg portion and the back left leg portion;

a right leg assembly, having a curved right leg member, the curved right leg member having a front right leg portion, a back right leg portion, and a central portion connecting the front right leg portion and the back right leg portion;

a U-shaped member, having a middle portion, a left arm having a left arm end, and a right arm having a right arm end, wherein the left arm is attached to the central portion of the left leg member and the right arm is attached to the central portion of the right leg member so that the middle portion acts to connect the left leg member and the right leg member, and further wherein the U-shaped member substantially defines the plane of the seat support, the seat support being supported by the U-shaped member, and wherein the middle portion of the U-shaped member is proximate to the front of the chair so that the left arm end and the right arm end are proximate to the back of the chair, a front left spring channel, attached to the left arm of the U-shaped member proximate to the left arm end;

a front right spring channel, attached to the right arm of the U-shaped member proximate to the right arm end;

the front spring channels each being generally J-shaped or U-shaped with a pair of spaced apart, generally vertical sides interconnected by a generally horizontal central portion;

a back support assembly, including a back frame formed from a single curved back frame member, the curved back member having a back left frame end and a back right frame end, a back left spring channel, attached to back frame member proximate to the back left frame end, a back right spring channel, attached to the back frame member proximate to the back right frame end;

a left spring, connected to the front left spring channel and the back left spring channel; and a right spring, connected to the front right spring channel and the back right spring channel;

the rear spring channels each being generally J-shaped or U-shaped with a pair of spaced apart, generally vertical sides interconnected by a generally horizontal central portion;

wherein the left spring and right spring act to connect the back frame member to the seat support assembly, the left spring and the right spring allowing the back frame member to flex in relation to the seat support assembly.

25. The chair of claim 24, further comprising:

a front lateral bar connecting the front left leg portion of the left leg member and the front right leg portion of the right leg member;

a back lateral bar connecting the back left leg portion of the left leg member and the back right leg portion of the right leg member;

a left leg strengthening bar connecting the front left leg portion and the back left leg portion of the left leg member; and a right leg strengthening bar connecting the front right leg portion and the back right leg portion of the right leg member.

26. The chair of claim 24, wherein the left spring and the right spring each comprise a non-woven fiberglass reinforced epoxy resin material.

* * * * *

UNITED STATES PATENT AND TRADEMARK OFFICE

CERTIFICATE OF CORRECTION

PATENT NO. : 6,820,934 B2
DATED : November 23, 2004
INVENTOR(S) : R. Duane Ware

It is certified that error appears in the above-identified patent and that said Letters Patent is hereby corrected as shown below:

Column 1,
Line 35, replace “coming” with -- corning --.

Column 10,
Lines 22 and 64, replace “sear” with -- seat --.
Line 56, replace “left” with -- right --.

Column 11,
Line 44, replace “seal” with -- seat --.

Column 12,
Line 57, replace “(he” with -- the --.

Signed and Sealed this

Eleventh Day of October, 2005

JON W. DUDAS
*Director of the United States Patent and Trademark Office*